FIP7811 XR 4,043,596

United States Patent [19]

Ridley

[11] 4,043,596

[45] Aug. 23, 1977

[54] FORMING SHALE OIL RECOVERY RETORT BY BLASTING INTO SLOT-SHAPED COLUMNER VOID

[75] Inventor: Richard D. Ridley, Grand Junction, Colo.

[73] Assignee: Occidental Oil Shale, Inc., Grand Junction, Colo.

[21] Appl. No.: 603,705

[22] Filed: Aug. 11, 1975

[51] Int. Cl.[2] ..... E21C 41/10

[52] U.S. Cl. ..... 299/2; 102/23; 299/13

[58] Field of Search ..... 102/22, 23; 166/299; 299/5, 13, 2

[56] References Cited

U.S. PATENT DOCUMENTS

| | | | |
|---|---|---|---|
| 423,908 | 3/1890 | Conner | 102/23 |
| 1,919,636 | 7/1933 | Karrick | 299/2 |
| 2,858,764 | 11/1958 | Hesson et al. | 102/22 |
| 3,001,776 | 9/1961 | Van Poollen | 299/2 |
| 3,316,020 | 4/1967 | Bergstrom | 299/2 |
| 3,434,757 | 3/1969 | Prats | 299/2 |
| 3,437,378 | 4/1969 | Smith | 166/299 |
| 3,466,094 | 9/1969 | Haworth et al. | 299/13 |
| 3,611,933 | 10/1971 | Lanning | 102/23 |
| 3,765,722 | 10/1973 | Crumb | 299/2 |
| 3,903,799 | 9/1975 | Walker | 102/23 |
| 3,917,346 | 11/1975 | Janssen | 299/13 |
| 3,917,347 | 11/1975 | Janssen | 299/13 |
| 3,917,348 | 11/1975 | Janssen | 299/13 |

*Primary Examiner*—Ernest R. Purser
*Attorney, Agent, or Firm*—Christie, Parker & Hale

[57] ABSTRACT

An in situ oil shale retort is formed in a subterranean oil shale deposit by excavating one or more slot-shaped columnar voids each having a pair of vertically extending, planar free faces, drilling blasting holes adjacent to the columnar void and parallel to the free faces, loading the blasting holes with explosive, and detonating the explosive in a single round to expand the shale adjacent to the columnar void one directionally toward each free face in one or more planar layers severed in a sequence progressing away from each free face and to fill with fragmented oil shale the columnar void and the space in the in situ retort originally occupied by the expanded shale prior to the expansion. The pair of free faces extend across the entire width (or length) of the retort being formed. A room having a horizontal floor plan that coincides approximately, with the horizontal cross section of the retort to be formed is excavated so as to intersect the columnar void. The blasting holes are drilled and loaded with explosive from the room.

51 Claims, 5 Drawing Figures

FORMING SHALE OIL RECOVERY RETORT BY BLASTING INTO SLOT-SHAPED COLUMNER VOID

CROSS-REFERENCE TO RELATED APPLICATIONS

This application is related to application Ser. No. 505,457, filed Sept. 12, 1974, by Gordon B. French, now abandoned and a continuation in part thereof Ser. No. 603,704 entitled "In Situ Recovery of Shale Oil", filed on even date herewith. The disclosures of these applications, which are assigned to the assignee of the present application, are incorporated herein by reference.

BACKGROUND OF THE INVENTION

This invention relates to the recovery of liquid and gaseous products from oil shale. The term "oil shale" as used in the industry is in fact a misnomer; it is neither shale nor does it contain oil. It is a formation comprising marlstone deposit interspersed with layers of an organic polymer called "kerogen" which upon heating decomposes to produce carbonaceous liquid and gaseous products. It is the deposit containing kerogen that is called "oil shale" herein, and the liquid product is called "shale oil."

One technique for recovering shale oil is to set up a retort in a subterranean oil shale deposit. The shale within the retort is fragmented and the shale at the top of the retort is ignited to establish a combustion zone. An oxygen containing gas is supplied to the top of the retort to sustain the combustion zone, which proceeds slowly down through the fragmented shale in the retort. As burning proceeds, the heat of combustion is transferred to the shale below the combustion zone to release shale oil and gases therefrom in a retorting zone. Thus, a retorting zone moves from top to bottom of the retort in advance of the combustion zone, and the resulting shale oil and gases pass to the bottom of the retort for collection.

In preparation for the described retorting process, it is important that the shale be fragmented, rather than simply factured, in order to create high permeability; otherwise, too much pressure is required to pass the gas through the retort. Known methods of creating such high shale permeability call for mining large volumes of the oil shale prior to fragmentation. This is objectionable in two respects. First, mining the shale and transporting it to the ground level are expensive operations. Second, the mined shale is excluded from the in situ retorting process, thus reducing the overall recovery of shale oil from the retort.

SUMMARY OF THE INVENTION

An in situ retort in a subterranean formation containing an oil shale deposit is formed by excavating at least one vertically extending columnar void that has a horizontally extending perimeter, leaving adjacent to a part only of the perimeter of the columnar void a portion of oil shale to be fragmented in the formation, and then filling the columnar void and the space occupied by the adjacent portion with fragmented oil shale by explosively expanding the adjacent portion of oil shale in a single round in one or more layers of oil shale parallel to the part only of the perimeter of the columnar void and in a sequence of such layers progressing away from the columnar void.

BRIEF DESCRIPTION OF THE DRAWINGS

The features of a specific embodiment of the best mode contemplated of carrying out the invention are illustrated in the drawings, in which:

— FIG. 1 is a side sectional view through a plane indicated in FIGS. 2 and 3, and FIGS. 2, 3, and 4 are top sectional views through planes indicated in FIG. 1.

DETAILED DESCRIPTION OF SPECIFIC EMBODIMENT

Figure 1:
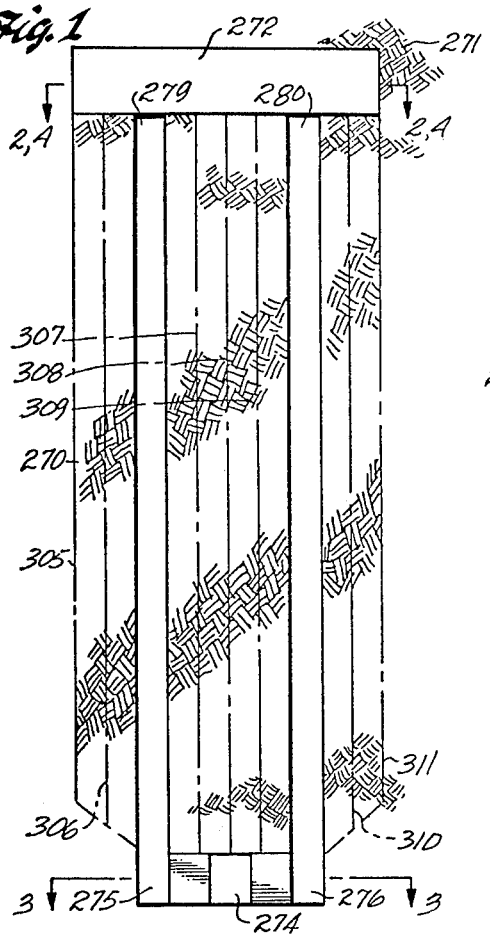
FIGS. 1 through 4 depict a portion of a subterranean oil shale seam during exavation of slots and preparation of the shale adjacent to the slot-shaped columnar voids for one directional expansion towards a free face

A retort in a subterranean formation containing oil shale, having top, bottom and side boundares of unfragmented formation is formed by excavating a first portion of the oil shale from within such boundaries to form at least one columnar void, the surface of the formation which defines the columnar void presents at least one free face that extends vertically through the subterranean oil shale deposit, and leaves a second portion of the formation, which is to be fragmented by expansion toward the columnar void; within the boundaries of the retort and extending away from a free face. The second portion is explosively expanded toward the columnar void in one or more segments, including at least one layer, of formation parallel to a free face. The expansion of the oil shale toward the columnar void fragments the oil shale thereby distributing the void volume of the columnar void throughout the retort.

The columnar void can be formed by any of a number of methods, including excavation procedures useful for forming shafts, raises and winzes. Burn cutting rounds, angle cutting rounds, or combinations or angle cutting and burn cutting rounds are useful for forming the columnar void.

Placement of the explosive for expanding the oil shale toward the free face of the columnar void is preferably accomplished by drilling blasting holes through the oil shale adjacent to the columnar void and parallel to the free face and loading the blasting holes with the explosive.

The columnar void is a slot providing two large parallel planar vertical free faces extending substantially over the entire width of the retort to be formed; the blasting holes are arranged in planes parallel to the free faces so the shale within the planes expands in one direction toward each free face upon detonation of the explosive.

The columnar void extends vertically for the greater part of the height of the retort to be formed. However, the height of the columnar void can exclude the portion of the height of the retort to be formed attributable to work rooms, any pillar separating a work room from a columnar void, and any other portion of the height of the retort being formed from which the shale is blasted to a horizontal free face, such as a dome-shaped portion at the top boundary. In any case, the height of the columnar void would usually be greater than three-quarters of the height of the retort.

The explosive used for expanding the oil shale toward the planar free face of the columnar void is detonated in an outwardly progressing sequence such that the oil shale adjacent to the columnar void is expanded toward the free face of the columnar void and the remainder of the explosive in the retort is detonated before the expanded oil shale adjacent to the columnar void falls appreciably due to the force of gravity.

The general art of blasting rock deposits is discussed in The Blasters' Handbook, 15th Edition, published by E. I. duPont de Nemours & Company, Wilmington, Delaware.

The location of the base of operation or work area from which the blasting holes are drilled and loaded with explosive can be located within or external to the boundaries of the retort to be formed. The base of operation can be one or more tunnels lying either outside or within the retort to be formed. Usually, however, the base of operation is a room lying within the space in which the retort is to be formed. The room has a floor plan that coincides approximately with the horizontal cross section of the retort to be formed and lies in a plane extending approximately perpendicular to the free face of the columnar void to provide unlimited access to the region adjacent to the columnar void for drilling and explosive loading equipment. This room can be at the upper boundary of the retort, the lower boundary of the retort, or at intermediate levels between the upper and lower boundaries of the retort. There can also be more than one base of operation along the height of the columnar void from which blasting holes are drilled and loaded.

The distributed void fraction of the retort, i.e., the ratio of the void volume to the total volume in the retort, is controlled by selecting the horizontal cross-sectional area of the columnar void or voids. The horizontal cross-sectional area of the columnar void or voids is sufficiently small compared to the horizontal cross-sectional area of the retort that the expanded shale is capable of filling the columnar void or voids and the space occupied by the expanded shale prior to detonation of the explosive. In other words, the horizontal cross-sectional area of the columnar void or voids is not so large that the expanded shale occupies less than the entire space of the columnar void or voids and the space occupied by the expanded shale prior to detonation of the explosive. Thus, remote from the work rooms, the shale in a horizontal slice of the retort along the height of a columnar void, i.e. a segment between two horizontal planes, moves essentially toward the columnar void without moving appreciably upward or settling downwardly. This promotes a more uniform permeability and distribution of void volume along the height of the retort, because remote from the work rooms there is no appreciable vertical displacement of the fragmented shale. In filling a columnar void and the space occupied by the expanded shale prior to detonation, the particles of the expanded shale become jammed and wedged together tightly so they do not shift or move after fragmentation has been completed. In numerical terms, the horizontal cross-sectional area of the columnar void should be at least less than about 40% of the horizontal cross-sectional area of the retort, in order to fill the columnar void and the space occupied by the expanded shale prior to detonation. In one embodiment of this invention, the horizontal cross-sectional area of the columnar void is preferably not greater than about 20% of the cross-sectional area of the retort, as this is found to provide a void volume in the fragmented oil shale adequate for satisfactory retorting operation.

The horizontal cross-sectional area of the columnar void is also sufficiently large compared to the horizontal cross-sectional area of the retort so that substantially all of the expanded shale within the retort is capable of moving enough during explosive expansion to fragment and for the fragments to reorient themselves. If the horizontal cross-sectional area of the columnar void is too small, a significant quantity of the shale within the retort volume can fracture without fragmenting. If the shale fractures without fragmenting, as when the space for explosive expansion of the shale is insufficient, fissures can be formed and the shale frozen in place without fragmentation. The void volume in fractured (but not fragmented) shale is neither large enough nor suitably distributed for efficient in situ retorting, and the permeability is too small to provide the prescribed gas flow rate through the retort at a reasonable pressure.

When the fragmented shale particles are later retorted, they increase in size. Part of this size increase is temporary and results from thermal expansion, and part is permanent and is brought about during the release of kerogen from the shale. The void volume of the fragmented shale should also be large enough for efficient in situ retorting as this size increase occurs. In numerical terms, the minimum average horizontal cross-sectional area of the columnar void in view of the above consideration should be above about 10% of the horizontal cross-sectional area of the retort. Below this average percentage value, an undesirable amount of power is required to drive the gas blowers and compressors supplying the retorting gas to the retort.

Within the range of 10% to 20%, the especially preferred horizontal cross-sectional area for the columnar void is about 15% of the horizontal cross-sectional area of the retort. The data collected to data from work in the Piceance Basin of Colorado indicate this value provides a good balance among the various characteristics of the retort, i.e., void volume, permeability, and particle size, without having to excavate excessive amounts of shale to form the columnar void. For example, a retort having a height of about 100 feet can require a pressure drop of less than about 1 psi from top to bottom for vertical movement of a mixture of air and off gas down through the retort at about 1 to 2 standard cubic feet per minute (scfm) per square foot of horizontal cross section of the retort, while retorts having greater heights would require proportionally larger pressure drops. Thus, an adequate gas flow rate through retorts up to 1000 feet in height can be provided with a pressure drop of less than 10 psi from top to bottom. In some areas of the Piceance Basin, a gas pressure of greater than 10 psi is objectionable because it results in excessive gas leakage into the intact shale around the retort.

The above percentage values assume that all the shale within the boundaries of the retort is to be fragmented, i.e., there are no intact, i.e., unfragmented regions left in the retort. If there are unfragmented regions left in the retort, e.g., for support pillars or the like, the percentages would be less.

The above percentage values also apply when the relationship between the size of the columnar void and the formation that is to be expanded is expressed in terms of volume, i.e., the volume of the columnar void is from about 10% to about 20% , preferably about 15%, of the combined volume of the columnar void and of the space occupied prior to expansion by that portion of the formation that is to be expanded to fill both the columnar void and such space.

The percentages in terms of volume as stated above, do not change when fragmented regions are planned to be left in the retort, as in the case of support pillars, or when multiple columnar voids are employed.

The method of this invention for fragmenting oil shale is useful for forming a retort of any desired dimension. When forming a retort of a relatively small cross-sectional area, a single columnar void can be excavated through the oil shale deposit in which the retort is being formed and the oil shale surrounding the columnar void expanded toward the columnar void to form the retort. In the formation of a retort having a relatively large cross-sectional area, several columnar voids can be used; the planar free faces of the columnar voids are generally parallel. The sum of the horizontal cross-sectional areas of the columnar voids meets the requirements described above in connection with the horizontal cross-sectional area of a single columnar void. The columnar voids can be spaced through the retort being formed so that all the oil shale within the retort is fragmented and expanded toward the columnar voids. In retorts having a relatively large cross-sectional area a portion of the oil shale can be left unfragmented in the form of vertical pillars to serve as support for the overburden, if necessary. The amount of oil shale left unfragmented in the form of pillars is taken into consideration when determining the volume of the columnar voids.

Many oil shale deposits have bedding plane dips of less than about 5%, in which case the columnar voids would be oriented so the free face extends substantially vertically and the resulting retort has substantially vertical side boundaries. If the the dip of the oil shale deposit is more than about 5%, the columnar void can be oriented so that the free face and the blasting holes extend substantially perpendicular to the plane of the deposit. The result would be a retort that is reoriented accordingly to conform to the bedding plane so that thr side boundaries of the retort are perpendicular to the bedding plane. This provides oil shale having approximately the same oil content across the retorting zone at any particular time as it advances through the retort.

The recovery of shale oil and product gas from the oil shale in the retort generally involves the movement of a retorting zone through the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries such that the shale oil and product gases produced in the retorting zone will move by the force of gravity and with aid of gases (air or heated gases) introduced at the upper boundary and moved to the lower boundary of the retort for collection.

A combustion zone can be established at or near the upper boundary of a retort by any of a number of methods. Reference is made to application Ser. No. 536,371, filled Dec. 26, 1974, by Chang Yul Cha, now abandoned and assigned to the assignee of the present application, for one method in which an access conduit is provided to the upper boundary of the retort, a combustible gaseous mixture is introduced therethrough, and ignited in the retort. Flue gases are withdrawn through an access means extending to the lower boundary of the retort, thereby bringing about a movement of gases from top to bottom of the retort through the fragmented oil shale. A combustible gaseous mixture of a fuel, such as propane, butane, natural gas, or retort off gas, and air is introduced through the access conduit to the upper boundary and is ignited to initiate a combustion zone at or near the upper boundary of the retort. Combustible gaseous mixtures of oxygen and other fuels are also suitable. The supply of the combustible gaseous mixture to the combustion zone is maintained for a period sufficient for the oil shale at the upper boundary of the retort to become heated usually to a temperature of greater than about 900° F., (although retorting begins at about 600° F) so that combustion can be maintained by the introduction of air (without fuel gas) into the combustion zone. Such a period can be from about one day to about a week in duration.

The combustion zone is maintained and advanced through the retort toward the lower boundary by introducing an oxygencontaining inlet gas through access conduits to the upper boundary of the retort and withdrawing flue gases from below the retorting zone. The inlet gas is generally a mixture of air and a diluent such as retort off gas or water vapor having an oxygen content of about 10% to 20% of the volume of the inlet gas. The inlet gas is moved through the retort at a rate of about 0.5 to 2 standard cubic feet of gas per minute per square foot of cross-sectional area of the retort.

The introduction of a inlet gas at the top and the withdrawal of flue gases from the retort at a lower level serves to carry the hot combustion product gases and non-oxidized inlet gases (such as nitrogen, for example) from the combustion zone and through the retort and establishes a retorting zone on the advancing side of the combustion zone. In the retorting zone, kerogen in the oil shale is converted to liquid and gaseous products. The liquid products move by the force of gravity to the lower boundary of the retort where they are collected and withdrawn, and the gaseous products mix with the gases moving through the in situ retort and are removed as retort off gas from a level below the retorting zone. The retort off gas is the gas removed from such lower level of the retort and includes inlet gas, flue gas generated in the combustion zone, and product gas generated in the retorting zone.

Reference is made to FIGS. 1 through 4, which depict a retort 270 to be formed in a horizontal oil shale seam 271 in a substerranean oil shale formation. Briefly, a slot-shaped columnar void extends across the entire width (or length) of the retort and the layers to be expanded do not completely surround the columnar void, but are instead parallel to the two planar free faces extending across the width of the entire retort. This is to be distinguished from the multi-directional expansion toward a cylindrical free face described in the referenced applications of Gordon B. French. Thus, the expansion toward each of the two free faces is one directional, and the expanded shale does not tend to wedge during expansion, to the extent it does during inward multi-directional expansion toward a cylindrical free face. Consequently less explosive is required to fragment a give amount of oil shale or the same quantity of explosive will fragment a given amount of oil shale more thoroughly. Also, more even distribution of the void volume throughout the retort results.

To prepare seam 271 for in situ recovery of shale oil, a horizontal room 272 is first excavated near the top thereof. Room 272, which has a square floor plan in this embodiment coinciding approximately with the horizontal cross section of retort 270, extends along a level near the upper boundary of retort 270. A tunnel 273 and a shaft or drift (not shown) connect room 272 to ground level. Parallel tunnels 274, 275, and 276 lie under room 272 near the lower boundary of retort 270. Tunnel 274, which lies under tunnel 273, is connected to ground level by a shaft or drift (not shown). Tunnel 275 is connected to tunnel 274 by oblique tunnels 277*a*, 277*b*, and 277*c*. Tunnel 276 is connected to tunnel 274 by oblique tunnels 278*a*, 278*b*, and 278*c*.

After room 272 and tunnels 273 through 278 are excavated, slot-shaped columnar voids 279 and 280, hereafter designated "slots", are excavated. Slots 279 and 280 extend vertically downward from the bottom of room 272 to the top of tunnels 275 and 276 respectively, and extend horizontally completely across room 272. The horizontal cross section of slots 279 and 280 coincides with the floor plan of the portions of tunnels 275 and 276, respectively, which are within the lateral boundaries of the retort which is being formed.

Figure 4:
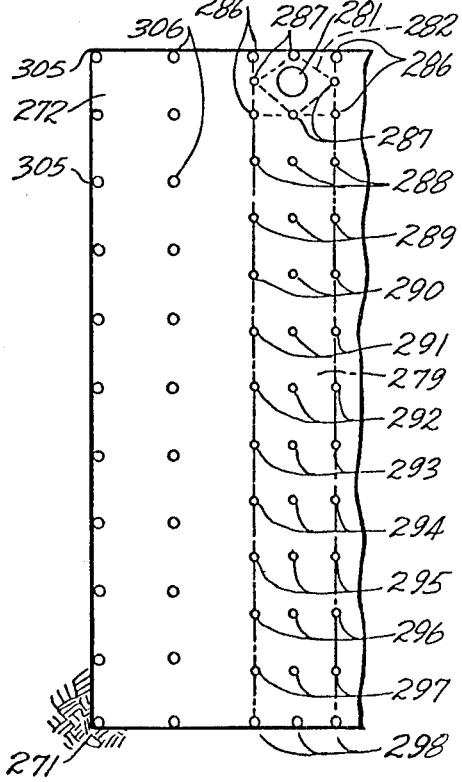

FIG. 4 represents room 272 prior to formation of slot 279, which is designated by phantom lines. To excavate slot 279, a small columnar void 281 is first bored down from the floor of room 272 to tunnel 275 near one end of slot 279. Blasting holes 286 are drilled down from the corners of a square region in the floor of room 272 surrounding columnar void 281 to tunnel 275. Blasting holes 287 are drilled down from the floor of room 272 between blasting holes 286 to tunnel 275. Blasting holes 287 are loaded with an explosive, such as ANFO, which is detonated. The resulting debris falls into tunnel 275 from which it is removed via tunnel 277*c* and tunnel 274, leaving a vertically elongated columnar void having a diamond-shaped cross section indicated at 282. Thereafter, blasting holes 286 are loaded with an explosive, which is detonated. The resulting debris falls into tunnel 275 from which it is removed via tunnel 277*c* and tunnel 274, leaving a vertically elongated columnar void having a square horizontal cross section. Next, blasting holes 288 are drilled down from the floor of room 272 to tunnel 275, and loaded with an explosive, which is then detonated to enlarge the vertically elongated columnar void. Next, blasting holes 289 are drilled down from the floor of room 272 to tunnel 275, loaded with an explosive charge, and detonated to further enlarge the vertically elongated columnar void. Similarly, blasting holes 290, 291, 292, 293, 294, 295, 296, 297, and 298 are in turn drilled, loaded, and detonated to expand the vertically elongated columnar void completely across room 272, thereby forming slot 279. After each detonation, the debris falling into tunnel 275 is removed therefrom via tunnels 277*a*, 277*b*, and 277*c*, and tunnel 274. Alternatively, all of blasting holes 286 through 298 could be drilled prior to loading with explosive and detonation. As illustrated in FIG. 4, blasting holes 286 through 298 are arranged in three rows extending across room 272; two of the rows are aligned with the sides of slot 279, and the third row lies midway between the first two rows. Slot 280 is excavated in the same manner as slot 279, either simultaneously therewith or thereafter.

The large vertical surfaces of each of slots 279 and 280 provide two planar free faces extending vertically through retort 270 substantially over its entire width (or length) and a greater part of its height. The formation extending from each free face is expanded in a direction normal thereto, i.e. one-directional. All the shale extending from a free face that is to be expanded toward a free face in a columnar void, i.e., the shale between one free face in slot 279 and one side boundary of retort 270 and the shale between the other free face in slot 279 and the row of blasting holes 308, on the one hand, and the formation containing oil shale between one free face in slot 280 and another side boundary of retort 270 and the shale between the other free face in slot (columnar void) 280 and the row of blasting holes 308, on the other hand, is explosively expanded in a plurality of parallel planar layers in a rapid sequence progressing away from the planar free faces. In this manner, the portion of the formation, which is to be fragmented by expansion towards a columnar void, and which is within the boundaries of the retort and extends away from such a free face, is explosively expanded toward such a columnar void. The free faces are still regarded as vertical although they may deviate slightly from verticality to achieve alignment with a vertical cleavage plane, in the manner taught in application Ser. No. 563,607. The volume of retort 270 is defined approximately by the area of the floor plan of room 272 and the height of slots 279 and 280 plus room 272. In other words, the horizontal cross section of retort 270 conincides approximately with the floor plan of room 272 and the vertical height of retort 270 approximately equals the height of slots 279 and 280 plus the height of room 272. Since the expansion of shale is one-directional with respect to each face in this embodiment, as distinguished from the embodiment in which the shale is expanded multi-directionally to a cylindrical columnar void, this embodiment is suitable for forming an in situ retort having a hroizontal cross-sectional area with a non-square rectangular shape. The void fraction of the fragmented shale formed within retort 270 along a major portion of the height of the columnar void is determined by the ratio of the sum of the horizontal cross-sectional areas of slots 279 and 280 to the horizontal cross-sectional area of the retort 270 at such section. The overall void fraction in the fragmented shale in the retort can be expressed as the ratio of the sums of the volumes of the columnar void and of the work room to the volume of the retort that is filled with fragmented shale.

Parallel rows of blasting holes 305, 306, 307, 308, 309, 310, and 311 are drilled down from the floor of room 272 to the bottom of retort 270. Row 305 is arranged along one side of room 272. Row 306 lies midway between row 305 and one free face of slot 279. Row 308 lies midway between the other free face of slot 279 and one free face of slot 280. Row 307 lies midway between the other free face of slot 279 and row 308, and row 309 lies midway between the one free face of slot 280 and row 308. Row 311 is arranged along the other side of room 272, and row 310 lies midway between row 311 and the other free face of slot 280. Rows of blasting holes 306 and 310 are incrementally shorter than the height of slots 279 and 280, and rows of blasting holes 305 and 311 are incrementally shorter than the height of rows of blasting holes 306 and 310 so as to provide a slope for the bottom of retort 270; thus, although these blasting holes do not extend the entire height of slots 279 and 280, they do extend a principal portion of the entire height. In other words, each blasting hole terminates at a point, on a vertical section passing through the blasting hole, in the retort being formed such that the ends of the blasting holes are located on a surface of the non-planar end boundary that is formed upon the detonation of explosive in the holes. Rows of blasting holes 305 through 311 are all loaded with an explosive, such as ANFO, which is detonated in a single round progressing sequentially outwardly from the free faces of slots 279 and 280. Rows of blasting holes 307, 308, and 309 extend to the level of the floor of tunnels 274 through 277, except for those blasting holes that lie directly above tunnels 274 through 277. Thus, the intact shale pillars between tunnels 274 through 277 (FIG. 7) are fragmented when the exposive in rows of blasting holes 307, 308, and 309 is detonated. In one embodiment, rows of blasting holes 306, 307, 309, and 310 are all provided with No. 1 and No. 2 fuses in alternate blasting holes, and rows of blasting holes 305, 308, and 311 are all provided with No. 4 and No. 6 fuses in alternate blasting holes, where the fuse numbers have the time delays given above. Instead of drilling rows of blasting holes 305 through 311 after excavation of slots 279.

In one embodiment, room 272 has a square floor plan that is about 120 feet on a side, and a height of about 30 feet. Slots 279 and 280 each have a length of about 120 feet, a width of about 12 feet, and a height of about 252 feet, and the resulting void fraction along the height of slots 279 and 280 is approximately 20 percent. Tunnels 274, 275, 276, and **277*a* through 277*c* have a height of about 15 feet. Tunnels 275 and 276 have a length of about 120 feet and a width of about 12 feet, tunnels 274 and 277*a* through 277*c* have a width of about 15 feet. Columnar void 281 has a diameter of about 6 feet and is centered on an axis spaced about 6 feet from the side of retort 270 and about 6 feet from each free face of sot 279 which is to be formed. Blasting holes 286 through 298 each have a diameter of about 4-½ inches. Blasting holes 286 and 287 are spaced about 6 feet from each other. Blasting holes 288 are spaced about 6 feet from each other and about 8 feet from the closest of the adjacent group of blasting holes 286 and 287. Blasting holes 289 through 298 are all spaced about 6 feet from each other and about 10 feet from the adjacent group of blasting holes. The blasting holes of rows 305 through 311 each have a diameter of about 6¼ inches. The blasting holes of rows 305 through 311 are all spaced about 12 feet from each other and about 12 feet from the next adjacent row of blasting holes and/or about 12 feet from the next adjacent free face of slot 279 or 280. In summary, in the formation of retort 270 of this embodiment two 6 foot diameter raises are bored, 82 4½ inch blasting holes are drilled, and 77** 6¼ inch blasting holes are drilled.

As first the explosive in rows of blasting holes 306, 307, 309, and 310 is detonated and thereafter as the explosive in rows of blasting holes 305, 308, and 311 is detonated, the shale is expanded toward slots 279 and 280 in vertical planar layers aligned with slots 279 and 280, i.e., parallel to their free faces. The layers of shale are severed in a sequence progressing away from the free faces of slots 279 and 280 and fragmented.

Another embodiment is identical to that described in the preceding two paragraphs except that the three rows of blasting holes between slots 279 and 280, i.e., rows 307, 308, and 309, are replaced with five rows of blasting holes. Progressing from slot 279 to slot 280, the first row is spaced about 9½ feet from slot 279, the second row is spaced about 9½ feet from the first row, the third row is spaced about 5 feet from the second row, the fourth row is spaced about 5 feet from the third row, and the fifth row is spaced about 9½ feet from the fourth row and about 9½ feet from slot 280. The blasting holes of each of the five rows are spaced about 15 feet apart. The blasting holes of the third row have a diameter of about 4½ inches, and the blasting holes of the other four rows have a diameter of about 6¼ inches. The explosive in the first and fifth rows is detonated first, followed by the explosive in the second and fourth rows, and finally by the explosive in the third row.

Instead of locating room 272 near the top of the retort, it can be located near the bottom or intermeidate the top and bottom, as disclosed in the referenced applications of Gordon B. French in connection with cylindrical columnar voids.

Instead of employing room 272, which has a floor plan coinciding with the horizontal cross section of retort 270, the base of operations from which the blasting holes are drilled and loaded with an explosive charge can comprise tunnels lying outside the retort in the planes of the blasting holes. The blasting holes can be drilled so as to fan out from the tunnels or extend therefrom in parallel relationship.

In the embodiment of FIGS. 1 through 4, slots 279 and 280 provide four planar free faces toward each of which the shale in retort 270 is one-directionally expanded. In general, sufficient free faces are provided to fragment all the shale in retort 270 in two or three sequential layers or less, to minimize the delay between the first and last detonations. In the case of retorts of small cross-sectional area, expansion of shale toward one or both of the free faces of a single slot can be sufficient to achieve this purpose.

In summary, each of slots 279 and 280 has a plurality of vertically extending, planar free faces, namely, first and second parallel faces that extend across the entire width of retort 270 and third and fourth free faces that are perpendicular to and much narrower than the first and second free faces. A slot is defined as "a narrow, elongated depression, groove, notch, slit, or aperture", *Random House Dictionary of the English Language,* Random House, Inc., New York (1967), page 1342. In the context of the present specification the slot-shaped columnar void has a pair of parallel free faces having a width or horizontal extent greater than the distance between the pair of free faces. That is, in a horizontal plane the slot-shaped columnar void is longer than it is wide. In the specific embodiment disclosed, the third and fourth free faces are about one tenth as narrow as the first and second free faces. As to each of slots 279 and 280, the portion of oil shale adjacent to a number of the free faces less than the plurality thereof, namely, two of the free faces, is expanded toward such two free faces, which are the first and second free faces, in a plurality of planar layers parallel to the first and second free faces. Thus, the expanded portion of shale is adjacent to a part only of the perimeter of the slot, namely, the part defined by the first and second free faces.

Figure 5:
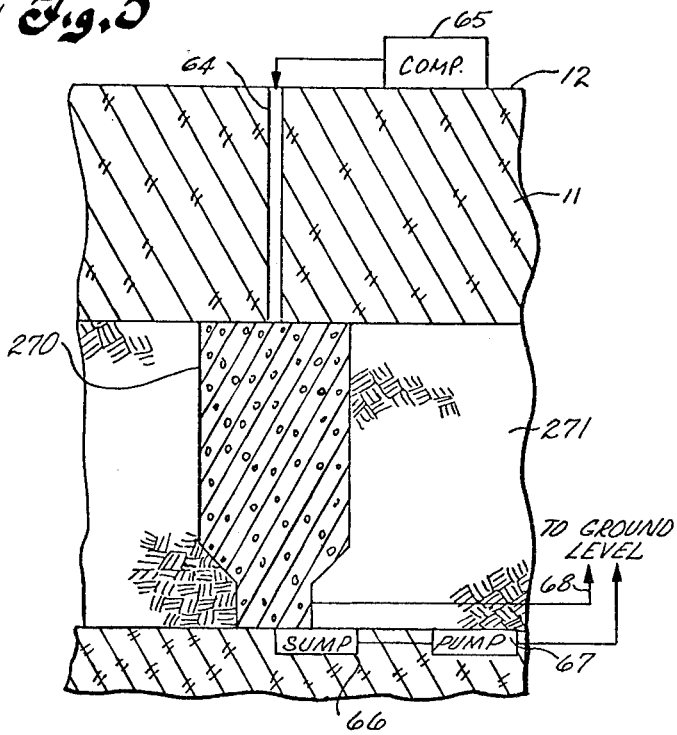
FIG. 5 is a side sectional view depicting a portion of the seam during retorting of the fragmented shale resulting from the expansion of the shale adjacent to the columnar voids in FIGS. 1 through 4.
Figure 2:
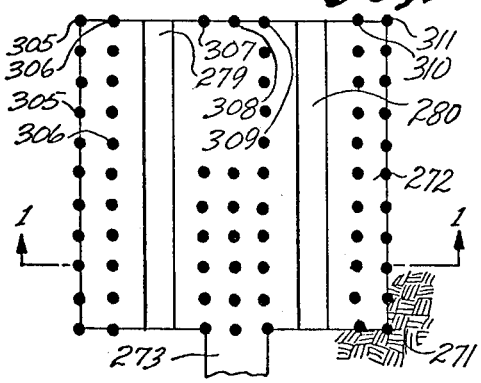
Figure 3:
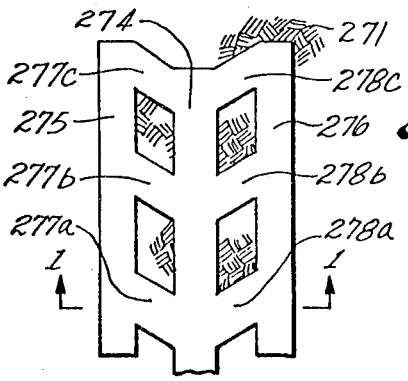

Retort 270 is shown in FIG. 5 ready for retorting after fragmentation of the oil shale therein. A gas inlet, represented for simplicity as a single conduit 64 extending through an overburden 11, connects a compressor 65 located at ground level 12 to one or more points distributed about the top of retort 270. Because of the permeability of the fragmented shale, compressor 65 is usually required to deliver air or other retorting gas at about 5 psi or less.

The fragmented shale at the top of the retort is ignited to establish a combustion zone, compressor 65 supplies air or other oxygen supplying gas for maintaining combustion in the combustion zone and for advancing the combustion zone slowly downward through the retort with a horizontal advancing front. Carbonaceous values comprising liquid shale oil and gases are released from the fragmented shale by the heat from the combustion zone in a retorting zone which is ahead of the advancing front of the combustion zone. Heat from the combustion zone is carried to the retorting zone on the advancing side of the combustion zone by combustion product gases and heated unburned inlet gases, such as nitrogen of the inlet air, which are caused to flow downwardly by the continued introduction of gases through the inlet to the top of the retort, and the withdrawal of gases from the bottom of the retort. The flowing hot gases heat the oil shale in the retorting zone a few feet thick. Kerogen in the oil shale is decomposed in the retorting zone releasing the shale oil and some hydrocarbon gases. The intact shale bordering the retort 270 is also partially retorted. The shale oil percolates downward to the bottom of the retort 270 in advance of the combustion zone, and the retort off gas is passed to the bottom of the retort 270 by the movement of gas introduced at the top of the retort 270, passed through the retort 270, and withdrawn at the bottom. Shale oil collects in a storage area in the form of a sump 66 which is located at the low point of an access to the bottom of the retort. Depending upon the slope of tunnels 274, 275, and 276, special grading and/or drainage ditches can be provided in the retort floor prior to the explosive expansion in order to provide drainage for the shale oil to sump 66. A pump 67 carries the shale oil from sump 66 through tunnel 274 to ground level. A conduit 68 carries the off gas recovered from the retorting process from the bottom of retort 270 via tunnel 274 to ground level.

Alternatively, an oxygen free retorting gas at a temperature sufficient to heat the fragmented oil shale in the retort to a retorting temperature is introduced into the top of the retort, bringing about the retorting of the oil shale in a retorting zone, and releasing the shale oil and gaseous retorting products from the in situ retort.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. The invention is limited only by the scope of the appended claims.

What is claimed is:

1. A method of forming an in situ oil shale retort in a subterranean formation containing oil shale, said retort having top, bottom and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surfaces of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of blasting holes in said second portion extending parallel to the free faces;

loading explosive into said blasting holes; and detonating said explosive for explosively expanding said second portion toward such columnar void.

2. The method of claim 1, wherein said explosive is detonated in a single round of a sequential series of a plurality of detonations progressing outwardly from said free faces, such that a plurality of segments, including at least one layer of formation parallel to said free face, are expanded sequentially progressing away from said free faces.

3. The method of claim 1 wherein fragmented oil shale in said retort is retorted by passing a retorting gas through said retort at a temperature sufficient to bring about retorting of said fragmented formation containing oil shale.

4. The method of claim 1, wherein fragmented oil shale in said retort is retorted by:

igniting the fragmented formation containing oil shale at the top of said retort and establishing a combustion zone;

introducing a combustion sustaining gas to said retort;

retorting said oil shale in said retort by the transfer of heat from said combustion zone to oil shale in a retorting zone; and collecting and withdrawing the liquid and gaseous retorting products from said retort.

5. The method of claim 1, wherein said blasting holes are arranged in a plurality of rows parallel to said free faces.

6. The method of claim 1, comprising in addition:

excavating a portion of the formation from within the boundaries of the retort to be formed to form at least one work room having a floor plan that is approximately coextensive with the horizontal cross section of the retort being formed;

drilling the blasting holes from said room, and loading the blasting holes from said room.

7. The method of claim 6, wherein a said work room is located near the top of the retort so that said columnar void lies below said work room.

8. The method of claim 6, comprising, in addition, the step of at least partially filling said work room with fragmented formation containing oil shale prior to the detonating step.

9. The method of claim 1, in which said blasting holes are formed by drilling a series of groups of said blasting holes substantially parallel to said free faces in said second portion;

and the explosive is detonated in a single round sequentially with the detonations of explosive in successive groups of blasting holes progressing outwardly from said free faces to explosively expand said second portion toward a columnar void.

10. The method of claim 9, wherein the detonation of the explosive in a group of blasting holes comprises two detonations having a time delay therebetween.

11. The method of claim 1, in which such a columnar void has a rectangular horizontal cross section, comprising first and second parallel planar vertically extending free faces and third and fourth parallel planar vertically extending free faces that are perpendicular to the first and second free faces.

12. The method of claim 11, in which the first and second free faces extend across the entire retort and the third and fourth free faces are much narrower than the first and second free faces.

13. The method of claim 12, in which the third and fourth free faces are about one-tenth as narrow as the first and second free faces.

14. The method of claim 1, in which the excavating step comprises excavating a first portion of formation having a horizontal cross-sectional area that is not greater than about 20% of the sum of the horizontal cross-sectional areas of the first and second portions.

15. The method of claim 1, in which the excavating step comprises excavating a first portion of formation having a horizontal cross-sectional area that is from about 10% to about 20% of the sum of the horizontal cross-sectional areas of the first and second portions.

16. The method of claim 1, in which the excavating step comprises excavating a first portion of formation having a horizontal cross-sectional area that is about 15% of the sum of the horizontal cross-sectional area of first and second portions.

17. The method of claim 1 wherein the volume of such a columnar void, compared to the combined volume of such a columnar void and of the space occupied by the second portion prior to the expansion of the second portion, is a. sufficiently so that the expanded second portion substantially fills such a columnar void and the space in the retort occupied by the second portion prior to the expansion, and b. sufficiently large so that the expanded second portion is fragmented.

18. The method of claim 1 wherein the explosive is detonated in a single round for explosively expanding said second portion toward such a columnar avoid.

19.The method of claim 1 wherein said explosive is detonated in a single round of a sequential series of detonations.

20. The method of claim 1 wherein said explosive is detonated in a single round of a sequential series of a plurality of groups of detonations.

21. The method of claim 1 comprising in addition:

excavating a portion of the formation at the site of the retort being formed to form at least one work area;

forming said blasting holes from such a work area; and loading explosive in said blasting holes from such a work area.

22. The method of claim 21 wherein such a work area is formed outside of the boundaries of the retort being formed.

23. The method of claim 21 wherein such a work area is formed within the boundaries of the retort being formed.

24. The method of claim 21 wherein such a work area is formed above said second portion and said blasting holes are formed to extend vertically in said second portion.

25. The method of claim 9 wherein said explosive is detonated in a single round of a sequential series of a plurality of groups of detonations progressing outwardly from the free faces with time delays between the detonations of the groups progressing outwardly for explosively expanding said second portion toward such a columnar void.

26. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one slot-shaped columnar void, the surfaces of the formation defining such a columnar void providing a pair of vertically extending parallel planar free faces extending substantially completely across the retort being formed, and leaving a second portion of said formation, which is to be fragmented by expansion toward such a columnar void, within said boundaries and extending away from the free faces; and explosively expandng said second portion toward such columnar void.

27. The method of claim 26, in which the expanding step comprises the steps of:

drilling a plurality of blasting holes into the second portion parallel to said free faces;

loading the blasting holes with explosive; and detonating the explosive in a single round to expand the second portion toward said free faces.

28. The method of claim 27, additionally comprising the step of excavating a room having a floor plan that lies within and coincides approximately with the horizontal cross section of the retort being formed, the drilling step comprises drilling the blasting holes vertically from the room and the loading step comprises loading the blasting holes from the room.

29. The method of claim 26, in which the sum of the horizontal cross-sectional areas of the columnar voids is not greater than about 20% of the sum of the horizontal cross-sectional areas of the first and second portions prior to excavation of the first portion and expansion of the second portion.

30. The method of claim 29, in which the sum of the horizontal cross-sectional areas of the columnar voids is not less than about 10% of the sum of the horizontal cross-sectional areas of the first and second portions prior to excavation of the first portion and expansion of the second portion.

31. The method of claim 26, in which the sum of the horizontal cross-sectional areas of the columnar voids is not less than about 10% of the sum of the horizontal cross-sectional areas of the first and second portions prior to excavation of the first portion and expansions of the second portion.

32. The method of claim 26, in which the sum of the horizontal cross-sectional areas of the columnar voids is about 15% of the sum of the horizonal cross-sectional areas of the first and second portions prior to excavation of the first portion and expansion of the second portion.

33. The method of claim 26, comprising excavating a portion of the formation at the site of the retort being formed to form a work room having a floor plan approximately coextensive with the cross section of the retort being formed, the room serving as a base of operations for executing the expanding step.

34. The method of claim 26 wherein the volume of such a columnar void compared with the combined volume of such a columnar void and of the space occupied by the second portion prior to the expansion of the second portion, is A. sufficiently small so that the expanded second portion fills such a columnar void and the space in the retort occupied by the second portion prior to the expansion, and B. sufficiently large so that the expanded second portion is fragmented.

35. A method of forming an in situ oil shale retort in a subterranean formation containing oil shale, said retort having boundaries of the formation and containing fragmented formation containing oil shale, the method comprising the steps of:

excavating a first portion of the subterranean formation at the site of the retort being formed to form at least one underground base of operations;

excavating a second portion of the formation from within the boundaries of the retort being formed to form at least two horizonaly spaced apart parallel slot-shaped columnar voids each having a pair of vertically extending parallel planar free faces within said boundaries that extend substantially completely across the portion of the formation within the boundaries of the retort being formed, leaving a second portion of said formation which is adjacent the free faces and within the boundaries of the retort being formed;

drilling from such an underground base of operations a plurality of blasting holes in said second portion extending parallel to the free faces;

loading the blasting holes with explosive from the base of operations; and detonating the explosive to expand said second portion of formation toward the voids.

36. The method of claim 35, in which the sum of the horizontal cross-sectional areas of the columnar voids relative to the horizontal cross-sectional area of the second portion is sufficiently small that the second portion after expansion fills the columnar voids and the space in the retort originally occupied by the second portion prior to expansion and sufficiently large so that the second portion completely fragments.

37. The method of claim 36, additionally comprising the step of excavating above the columnar voids a room having a floor plan coinciding approximately with the horizontal cross-sectional area of the retort being formed, the room comprising the underground base of operations.

38. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surfaces of the formation defining such a columnar void providing at least a pair of parallel planar free faces extending vertically through the oil shale formation within said boundaries, and leaving a sound portion of said formation which is adjacent the free faces and within the boundaries of the retort being formed;

forming a plurality of blasting holes in said second portion extending parallel to the free faces;

loading explosive into said blasting holes; and detonating said explosive in a single round of a sequential series of detonations progressing outwardly from the free faces for explosively expanding said second portion toward such columnar void.

39. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surfaces of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of blasting holes in said second portion extending parallel to the free faces;

loading explosive into said blasting holes; and detonating said explosive in a single round of a sequential series of groups of detonations progressing outwardly from the free faces for explosively expanding said second portion toward such columnar void.

40. A method of forming an in situ oil shale retort in a subterranean formation containing oil shale, said retort having top, bottom, and side boundaries of the formation and containing fragmented formation containing oil shale therein, comprising the steps of:

excavating a first portion of the formation form within the boundaries of the in situ oil shale retort being formed to form at least one vertically extending slot-shaped columnar void providing at least a pair of parallel planar free faces extending vertically through the oil shale formation within said boundaries, and leaving a second portion of said formation which is adjacent the free faces and within the boundaries of the retort being formed;

forming a plurality of blasting holes in said second portion extending parallel to the free faces;

loading explosive into said blasting holes; and detonating said explosive in a single round of a sequential series of groups of detonations progressing outwardly from the free faces with time delays between the detonations of the groups progressing outwardly for explosively expanding said second portion toward such columnar void.

41. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surfaces of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of vertically extending blasting holes in said second portion;

loading explosive into said blasting holes; and detonating said explosive for explosively expanding said second portion toward such columnar void.

42. The method of claim 41 wherein the volume of such a columnar void, compared to the combined volume of such a columnar void and of the space occupied by the second portion prior to the expansion of the second portion, is a. sufficiently small so that the expanded second portion substantially fills such a columnar void and the space in the retort occupied by the second portion prior to the expansion, and b. sufficiently large so that the expanded second portion is fragmented.

43. The method of claim 41 wherein the explosive is detonated in a single round for explosively expanding said second portion toward such a columnar void.

44. The method of claim 41 wherein said explosive is detonated in a single round of a sequential series of detonations.

45. The method of claim 41 wherein said explosive is detonated in a single round of a sequential series of a plurality of groups of detonations.

46. The method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surfaces of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of vertically extending blasting holes in said second portion;

loading explosive into said blasting holes; and detonating said explosive in a single round of a sequential series of detonations progressing outwardly from the free faces for explosively expanding said second portion toward such columnar void.

47. A method of forming an in situ oil shale retort in a subterranean formation containing oil shale, said retort having top, bottom, and said boundaries of the formation and containing fragmented formation containing oil shale therein, comprising the steps of:

excavating a first portion of the formation from within the boundaries of the in situ oil shale resort being formed to form at least one vertically extending slot-shaped columnar void, the surfaces of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of vertically extending blasting holes in said second portion;

loading explosive into said blasting holes; and detonating said explosive in a single round of a sequential series of groups of detonations progressing outwardly from the free faces for explosively expanding said second portion toward such columnar void.

48. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form at least one vertically extending slot-shaped columnar void, the surface of the formation defining such a columnar void providing at least a pair of parallel planar free faces extending vertically through the oil shale formation within said boundaries, and leaving a second portion of said formation which is adjacent the free faces and within the boundaries of the retort being formed;

forming a plurality of vertically extending blasting holes in said second portion;

loading explosive into said blasting holes; and detonating said explosive in a single round of a sequential series of groups of detonations progressing outwardly from the free faces with time delays between the detonations of the groups progressing outwardly for explosively expanding said second portion toward such columnar void.

49. A method of forming an in situ oil shale retort in a subterranean formation containing oil shale, comprising the steps of:

excavating a first portion of the formation from a region in the formation to form at least one vertically extending slot-shaped columnar void, the surfaces of the formation defining such a columnar void providing at least a pair of parallel planar free faces extending vertically through the formation within the region, and leaving a second portion of the formation, which is to be fragmented by expansion toward such a columnar void, within the region extending away from the free faces;

forming a plurality of blasting holes in said second portion extending parallel to the free faces;

loading explosive into said blasting holes; and detonating said explosive for explosively expanding said second portion toward such columnar void.

50. A method of forming an in situ oil shale retort in a subterranean formation containing oil shale, comprising the steps of:

excavating a plurality of first portions of the formation from a region in the formation to form a plurality of vertically extending slot-shaped columnar voids, the surfaces of the formation defining each columnar void providing at least a pair of parallel planar free faces extending vertically through the oil shale formation within the region, and leaving a plurality of second portions of the formation, which are to be fragmented by expansion toward the columnar voids, within the region and extending away from the free faces;

forming a plurality of blasting holes in each of said second portions extending parallel to the free faces;

loading explosive into said blasting-holes; and detonating said explosive for explosively expanding each of said second portions toward a columnar void to form a continuous mass of fragmented formation containing oil shale within the region.

51. A method of forming an in situ oil shale retort in a subterranean formation containing oil shale, said retort having top, bottom, and side boundaries of the formation and containing fragmented formation containing oil shale therein, comprising the steps of:

excavating a first portion of the formation from within the boundaries of the in situ oil shale retort being formed to form two slot-shaped columnar voids, the surfaces of the formation defining each such columnar void providing a pair of vertically extending parallel planar free faces extending substantially completely across the retort being formed, and leaving a second portion of said formation, which is to be fragmented by expansion toward said columnar voids, within said boundaries and extending away from the free faces; and explosively expanding at least part of said second portion of formation toward each of the two columnar voids.

* * * * *

UNITED STATES PATENT AND TRADEMARK OFFICE

CERTIFICATE OF CORRECTION

PATENT NO. : 4,043,596

DATED : August 23, 1977

INVENTOR(S) : Richard D. Ridley

It is certified that error appears in the above-identified patent and that said Letters Patent are hereby corrected as shown below:

Column 2, line 21, "boundares" should be -- boundaries --;
line 40, "or" should be -- of --.

Column 3, line 49, "upward" should be -- upwardly --.

Column 4, line 36, "data" (second occurrence) should be --date--.

Column 5, line 32, "5%" should be -- 5° --;
line 36, "5%" should be -- 5° --;
line 40, "thr" should be -- the --;
line 61, "filled" should be -- filed --.

Column 6, line 19, "oxygencontaining" should be -- oxygen-containing --;
line 28, "a" should be -- an --;
line 61, "give" should be -- given --.

UNITED STATES PATENT AND TRADEMARK OFFICE

CERTIFICATE OF CORRECTION

PATENT NO. : 4,043,596

DATED : August 23, 1977

INVENTOR(S) : Richard D. Ridley

It is certified that error appears in the above-identified patent and that said Letters Patent are hereby corrected as shown below:

Column 8, line 23, "conincides" should be -- coincides --;
line 32, "hroizontal" should be -- horizontal --.

Column 10, line 7, "intermeidate" should be -- intermediate --;
line 31, -- free -- should be inserted after "parallel" and before "faces".

Column 13, line 18, -- small -- should be inserted after "sufficiently" and before "so";
line 26, "avoid" should be -- void --.

Column 14, line 5, "expandng" should be -- expanding --;
line 37, "expansions" should be -- expansion --.

Column 15, line 3, "horizonaly" should be -- horizontally --;
line 46, "sound" should be -- second --.

Column 16, line 15, "form" should be -- from --.

Column 17, line 32, "said" should be -- side --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*